US007306428B2

(12) United States Patent
Schiebold et al.

(10) Patent No.: US 7,306,428 B2
(45) Date of Patent: Dec. 11, 2007

(54) GAS TURBINE WITH RUNNING GAP CONTROL

(75) Inventors: Harald Schiebold, Berlin (DE); Olaf Mistareck, Rangsdorf (DE); Thomas Wunderlich, Berlin (DE)

(73) Assignee: Rolls-Royce Deutschland Ltd & Co KG, Blankenfelde-Mahlow (DE)

( * ) Notice: Subject to any disclaimer, the term of this patent is extended or adjusted under 35 U.S.C. 154(b) by 0 days.

(21) Appl. No.: 10/933,257

(22) Filed: Sep. 3, 2004

(65) Prior Publication Data

US 2005/0089400 A1 Apr. 28, 2005

(30) Foreign Application Priority Data

Sep. 4, 2003 (DE) ..... 103 40 825

(51) Int. Cl.
*F01D 11/22* (2006.01)
*F01D 11/08* (2006.01)

(52) U.S. Cl. ..... 415/209.2; 415/209.3

(58) Field of Classification Search ..... 415/209.2, 415/209.3, 209.4, 136, 138, 139, 173.1, 173.2, 415/173.3, 174.1
See application file for complete search history.

(56) References Cited

U.S. PATENT DOCUMENTS 4,688,378 A * 8/1987 Harris ..... 60/800
5,141,394 A * 8/1992 Donlan ..... 415/190
5,149,250 A * 9/1992 Plemmons et al. ..... 415/209.3
5,224,822 A * 7/1993 Lenahan et al. ..... 415/189
5,372,476 A * 12/1994 Hemmelgarn et al. ..... 415/135
5,921,749 A * 7/1999 McLaurin et al. ..... 415/189
6,095,750 A * 8/2000 Ross et al. ..... 415/189

FOREIGN PATENT DOCUMENTS

DE 3038603 10/1980
GB 2061396 5/1981

* cited by examiner

*Primary Examiner*—Edward K. Look
*Assistant Examiner*—Nathan Wiehe
(74) *Attorney, Agent, or Firm*—Timothy J. Klima

(57) ABSTRACT

A gas turbine with several shroud segments (1) which enclose rotor blades (3) of a turbine wheel (5) as a seal, with the shroud segments (1) having at least a front and a rear attachment at the radially outward area of stator vane segments (7, 12), and with each of the stator vane segments (7, 12) being located at their radially inner area on a control ring (9, 10), wherein the stator vane segments (7, 12) are located on the control ring (9, 10) in a radially adjustable manner.

16 Claims, 3 Drawing Sheets

GAS TURBINE WITH RUNNING GAP CONTROL

This application claims priority to German Patent Application DE10340825.8 filed Sep. 4, 2003, the entirety of which is incorporated by reference herein.

BACKGROUND OF THE INVENTION

This invention relates to a gas turbine with several shroud segments which enclose rotor blades of a turbine wheel as a seal, with the shroud segments having at least a front or a rear attachment at the radially outward area of stator vane segments, and with each of the stator vane segments being located at their inner area on a control ring.

Such a design is disclosed in Patent Specification GB 2 061 396 A.

The control ring, by way of its thermal expansion, is used to adjust the outer circumference of the stator vane segments to the respective thermal conditions. Thus, the overall diameter of the ring formed by the shroud segments is decreased or increased, dependent upon temperature. In this manner, adjustment of the gap between the tips of the rotor blades and inner area of the shroud segments is achieved. Without such adjustment, thermal contraction or expansion of the rotor blades would lead to an increase of the gap or to a contact with the shroud segments.

Accordingly, the idea underlying the state of the art is to achieve optimum passive running gap control. As described, this is achieved by a thermal operating behavior of the attaching means of the shroud segments that is synchronized with the radial movement of the tips of the rotor blades. Ideally, the running gap in steady-state operation will not be affected by non-stationary operating conditions.

The known designs are disadvantageous in that optimum running gap control cannot be achieved under all installation conditions, this being due to the fact that the installation dimensions of the control ring, the stator vane segments and the shroud segments are invariable.

BRIEF SUMMARY OF THE INVENTION

In a broad aspect, the present invention provides a gas turbine with optimized passive running gap control which, while being simply designed and cost-effectively producible, is characterized by an optimized operating behavior.

It is one object of the present invention to provide solution to the above problems by a combination of the features described herein. Further advantageous embodiments of the present invention will be described below.

Accordingly, the present invention provides for a radially adjustable location of the stator vane segments on the control ring. The design according to the present invention is characterized by a variety of merits.

The adjustability of the rotor blades relative to the control ring enables compensation of component tolerances, for example, of the stator vane segments and also the shroud segments. This applies similarly to tolerance variations or eccentricities of the control ring.

A further, essential advantage is the precise adaptability to the thermal operating behavior that enables the dimensions of the ring gap seal (running gap) to be optimized in comparison with the basic design. Thus, axially symmetric and eccentric positional deviations can be compensated for without modification of the component.

In an advantageous development of the present invention, the stator vane segments are adjustably located on the control ring also in the circumferential direction. This allows appropriate adjustments to be made also in the circumferential direction before the stator vane segments and the shroud segments are finally assembled.

The adjustable location according to the present invention enables a precise adjustment to be made during assembly and to optimize the relationship of the components accordingly.

In a favorable further development of the present invention, the stator vane segments are attached to the control ring by means of a threaded connection with frictional lock. For example, a sleeve with a setting clearance or a segment with a setting clearance may be applied. In an alternative form of the present invention, adjustment may also be achieved by means of an eccentric device, for example a fitted sleeve with an eccentric.

It is also particularly advantageous if at least one secondary air seal is provided on the control ring and the control ring is designed such that its thermal operating behavior controls the width of the annular gap of the secondary air seal. For this, the control ring, which is arranged within the vane annulus, is designed such that its thermal operating behavior—in addition to the control of the running gap—is used for the control of at least one annular gap seal of the rotor cooling air system (secondary air system). Here, at least one secondary air seal attached to the control ring can be provided as a brush seal or multi-stage labyrinth seal. Thus, the annular gap of this seal will also be optimized accordingly by way of the thermal operating behavior.

Furthermore, it is particularly advantageous if the materials of the elements relevant for the thermal expansion of the control ring arrangement are selected such that their coefficient of thermal expansion is at least 15 percent smaller than the coefficient of thermal expansion of the respective adjacent rotor disk.

BRIEF DESCRIPTION OF THE DRAWINGS

The present invention is more fully described in light of the accompanying drawings showing preferred embodiments. In the drawings.

DETAILED DESCRIPTION OF THE INVENTION

Figure 3:
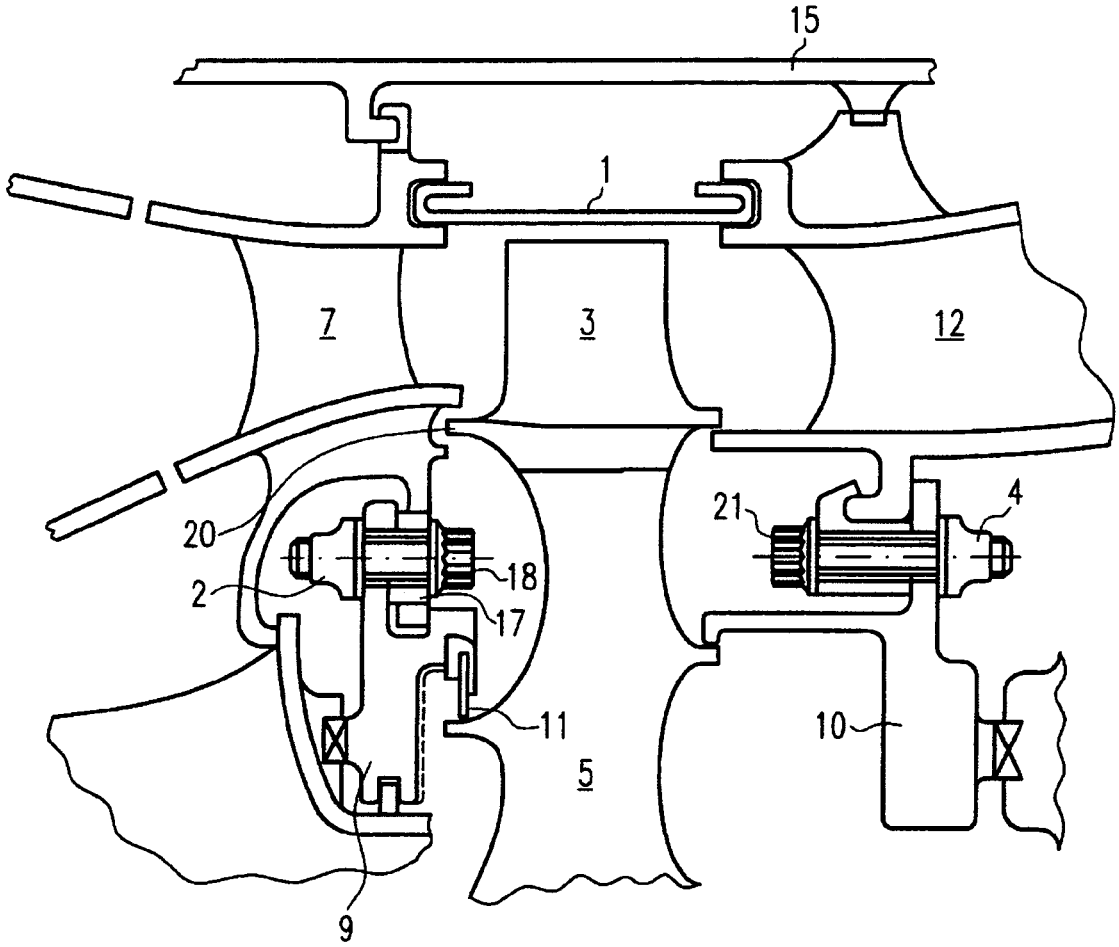
FIG. 3 is a partial overall view of a passive running gap control in accordance with the present invention.

FIG. 3 shows the shroud segment 1 which is related to the HPT stator vane segment 7 and to the LPT stator vane segment 12. A detailed illustration of the casing and the cooling air ducts within the casing is here dispensed with.

The stator vane segments 7 are installed upstream of the rotor blades 3, and the stator vane segments 12 downstream of said rotor blades, the rotor blades attached to a rotor disk 5 to form a turbine wheel in the generally known manner. Each stator vane segment is attached to a control ring, either a front control ring 9 or a rear control ring 10. Reference numeral 11 indicates a secondary air seal, which can be of the brush-type. Reference numeral 15 indicates a casing of the HPT. Reference numeral 6 indicates an inner load carrying element for stator vane segment 7.

Figure 1:
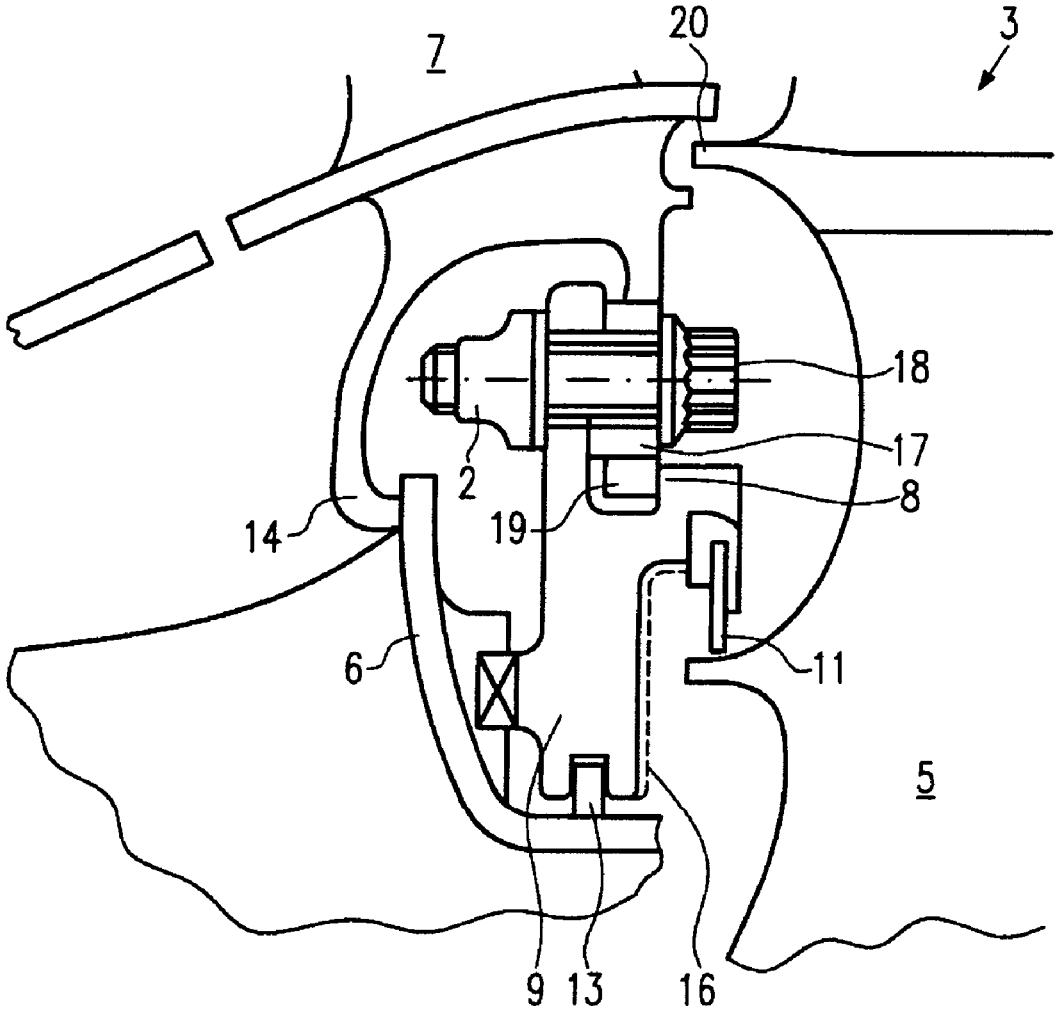
FIG. 1 is an enlarged partial view of a front control ring using the present invention.
Figure 2:
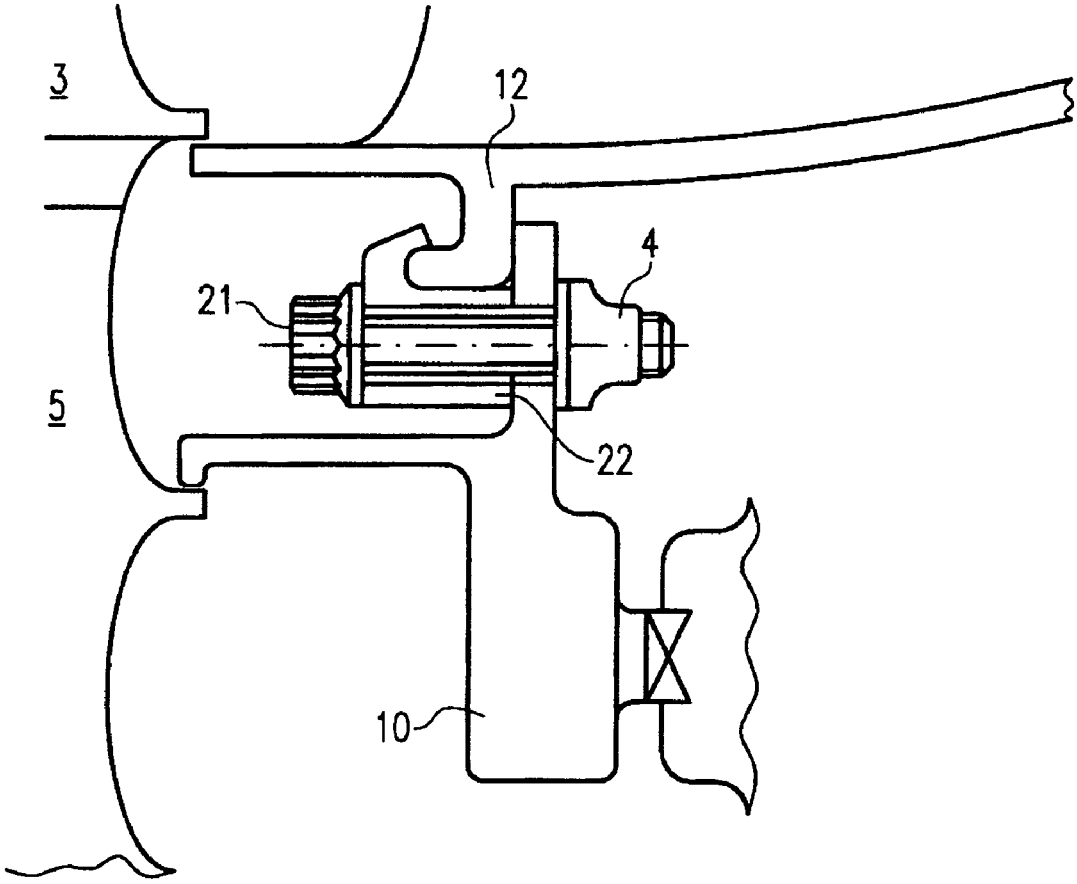
FIG. 2 is a an enlarged partial view of a rear control ring using the present invention.

The general design of the arrangement shown in FIG. 3 largely corresponds to the state of the art, with the variants according to the present invention being illustrated, in particular, in the enlarged FIGS. 1 and 2.

Besides the components already referenced and described, FIG. 1 additionally shows the attachment of the stator vane segments 7 to the control ring 9. The control ring 9 is provided with an insulation layer 16 to approximate the thermal behavior of the ring to that of the disk 5.

Attachment is accomplished by means of a sleeve 17, bolt 18 and nut 2, with a load compensation element 19 being additionally provided. The sleeve has a setting clearance, fixation is accomplished by means of a threaded connection using a bolt 18 with frictional lock. This enables the stator vane segment 7 to be set both radially and circumferentially to a certain extent. The inner seal, front control ring 13 and the outer seal, front control ring 8 enables the pressure through the control ring to be set. The load compensation element 19 relieves the load on the inner rotor blade attachment 14, thus enabling its size to be reduced. This has a favorable effect on the weight and cost of the entire arrangement.

Accordingly, each rotor blade is attached to the control ring 9 by means of a bolt 18. The sleeve 17 is located in the bottom protrusion of the stator vane (stator vane segment 7). As viewed from the sleeve center, the sleeve can transmit forces on the stator vane in the radial direction only. This allows the stator vane to be tilted axially and circumferentially about the sleeve center, as described. The bore diameter of the sleeve has a clearance with the bolt diameter, which provides for adjustability of the stator vanes relative to the control ring. Alternatively, an eccentric device can be used to adjust the stator vane. This can be in the form of an eccentric sleeve 17.

Therefore, in accordance with the present invention, the blade running gap can be improved by compensation of tolerance and asymmetry effects. Furthermore, in accordance with the present invention, secondary air leaks, which negatively affect air consumption, are reduced with minimal extra investment.

In accordance with the present invention, it is advantageous if at least one brush seal is provided as an integral element of the control ring. The respective materials (alloys) are here selected such that adaptation to the thermal behavior and the joining requirements of the control ring is made and the brush seal can be attached to the control ring without detachable fasteners.

In accordance with the present invention, the thermal and joining compatibility of the alloy of the brush seal, as well as the good heat transfer between the control ring and the brush seal resulting from the type of attachment, helps ensure that both components will always have nearly the same temperature. The thermal stresses between the control ring and the brush seal will be nearly constant at all times, thus permitting an inexpensive and space-saving axial retention of the positive type.

According to the present invention, the control ring and its positive attachment to the stator vane segments are designed such that an outer seal is provided on the control ring. In connection with the inner seal on the control ring, a pressure gradient over the control ring will compensate load at the location of the inner rotor blade attachment.

FIG. 2 shows the attachment of the stator vane segments 12 to the rear control ring 10 via adjustable attaching segments 22, bolts 21 and nuts 4. The positioning of the stator vanes 12 can be adjusted via movement of the adjustable attaching segments 22 in a manner similar to the attachment of the stator vane segments 7 to the front control ring 9 as described above.

LIST OF REFERENCE NUMERALS

1 Shroud segment
2 Nut
3 Rotor blade
4 Nut
5 Turbine wheel
6 Inner load-carrying element for 7
7 Stator vane segment of HPT
8 Outer seal, front control ring
9 Front control ring
10 Rear control ring
11 Secondary air seal
12 Stator vane segment of LPT
13 Inner seal, front control ring
14 Inner rotor blade attachment
15 Casing
16 Insulation layer
17 Sleeve
18 Bolt
19 Load compensation element
20 Seal
21 Bolt
22 Segment

What is claimed is:

1. A gas turbine having several shroud segments enclosing rotor blades of a turbine wheel in a sealing manner, the shroud segments having at least a front and a rear attachment at radially outward areas of respective stator vane segments, and each of the stator vane segments being connected at a radially inner area to a respective control ring with a connecting mechanism, wherein, in an untightened mode, the connecting mechanism allows the stator vane segments to be radially adjusted with respect to the respective control ring, and in a tightened mode, the connecting mechanism fixes the position of the stator vane segments with respect to the respective control ring.

2. A gas turbine in accordance with claim 1, wherein the stator vane segments are also circumferentially adjustable on the respective control ring when the connecting mechanism is in the untightened mode.

3. A gas turbine in accordance with claim 2, wherein the connecting mechanism includes a frictionally tight threaded connection.

4. A gas turbine in accordance with claim 3, wherein the connecting mechanism includes a clearance gap between the stator vane segments and the respective control ring to allow for the adjustability.

5. A gas turbine in accordance with claim 3, wherein the connecting mechanism includes an eccentric member positioned between the stator vane segments and the respective control ring, the eccentric member rotatable to adjust a radial position of the stator vane segments with respect to the respective control ring.

6. A gas turbine in accordance with claim 3, wherein the connecting mechanism includes adjustable segments positioned between the stator vane segments and the respective control ring to adjust the radial position of the stator vane segments with respect to the respective control ring.

7. A gas turbine in accordance with claim 3, and including at least one secondary air seal provided on the respective control ring, the control ring constructed and arranged such that its thermal operating behavior controls a width of an annular gap of a secondary air seal.

8. A gas turbine in accordance with claim 3, wherein the materials of the elements of at least one control ring have a coefficient of thermal expansion at least 15 percent smaller than that of an adjacent rotor disk.

9. A gas turbine in accordance with claim 3, wherein the stator vane segments are provided with load compensation elements for engaging the respective control ring.

10. A gas turbine, in accordance with claim 1, wherein the connecting mechanism includes a clearance gap between the stator vane segments and the respective control ring to allow for the adjustability.

11. A gas turbine in accordance with claim 1, wherein connecting mechanism includes an eccentric member positioned between, the stator vane segments and the respective control ring, the eccentric member rotatable to adjust a radial position of the stator vane segments with respect to the respective control ring.

12. A gas turbine in accordance with claim 1, wherein the connecting mechanism includes adjustable segments positioned between the stator vane segments and the respective control ring to adjust the radial position of the stator vane segments with respect to the respective control ring.

13. A gas turbine in accordance with claim 1, and including at least one secondary air seal provided on the respective control ring, the control ring constructed and arranged such that its thermal operating behavior controls a width of an annular gap of the secondary air seal.

14. A gas turbine in accordance with claim 13, wherein the control ring includes an insulation layer constructed and arranged to modify the thermal operating behavior of the control ring to control the width of the annular gap of the secondary air seal.

15. A gas turbine in accordance with claim 1, wherein the materials of the elements of at least one control ring have a coefficient of thermal expansion at least 15 percent smaller than that of an adjacent rotor disk.

16. A gas turbine in accordance with claim 1, wherein the stator vane segments are provided with load compensation elements for engaging the respective control ring.

* * * * *